US006540591B1

(12) United States Patent
Pasadyn et al.

(10) Patent No.: US 6,540,591 B1
(45) Date of Patent: Apr. 1, 2003

(54) METHOD AND APPARATUS FOR POST-POLISH THICKNESS AND UNIFORMITY CONTROL

(76) Inventors: Alexander J. Pasadyn, 8717 Dandelion Trail, Austin, TX (US) 78745; Christopher H. Raeder, 4604 Eagle Feather Dr., Austin, TX (US) 78735; Anthony J. Toprac, 4023 Walnut Clay, Austin, TX (US) 78731

( * ) Notice: Subject to any disclaimer, the term of this patent is extended or adjusted under 35 U.S.C. 154(b) by 0 days.

(21) Appl. No.: 09/837,606

(22) Filed: Apr. 18, 2001

(51) Int. Cl.[7] ..... B24B 1/00

(52) U.S. Cl. ..... 451/41; 451/5; 451/6; 451/8; 451/9; 451/287; 451/288

(58) Field of Search ..... 451/5, 6, 8, 9, 451/41, 60, 287, 288

(56) References Cited

U.S. PATENT DOCUMENTS 5,658,183 A * 8/1997 Sandhu et al. ..... 451/5
5,791,969 A * 8/1998 Lund ..... 451/5
6,108,091 A * 8/2000 Pecen et al. ..... 356/381
6,213,848 B1 * 4/2001 Campbell et al. ..... 451/41

* cited by examiner

*Primary Examiner*—Joseph J. Hail, III
*Assistant Examiner*—Shantese McDonald

(57) ABSTRACT

A method for polishing wafers includes providing a wafer having a process layer formed thereon; providing a polishing tool having a plurality of control zones and being adapted to polish the process layer based on an operating recipe, the operating recipe having a control variable corresponding to each of the control zones; measuring a pre-polish thickness profile of the process layer; comparing the pre-polish thickness profile to a target thickness profile to determine a desired removal profile; determining values for the control variables associated with the control zones based on the desired removal profile; and modifying the operating recipe of the polishing tool based on the values determined for the control variables. A processing line includes a polishing tool, a metrology tool, and a process controller. The polishing tool is adapted to polish a wafer having a process layer formed thereon based on an operating recipe. The polishing tool includes a plurality of control zones and the operating recipe includes a control variable corresponding to each of the control zones. The metrology tool is adapted to measure a pre-polish thickness profile of the process layer. The process controller is adapted to compare the pre-polish thickness profile to a target thickness profile to determine a desired removal profile, determine values for the control variables associated with the control zones based on the desired removal profile, and modify the operating recipe of the polishing tool based on the values determined for the control variables.

40 Claims, 4 Drawing Sheets

METHOD AND APPARATUS FOR POST-POLISH THICKNESS AND UNIFORMITY CONTROL

BACKGROUND OF THE INVENTION

1. Field of the Invention

This invention relates generally to semiconductor device manufacturing and, more particularly, to a method and apparatus for post-polish thickness and uniformity control.

2. Description of the Related Art

Chemical mechanical polishing (CMP) is a widely used means of planarizing silicon dioxide as well as other types of process layers on semiconductor wafers. Chemical mechanical polishing typically utilizes an abrasive slurry disbursed in an alkaline or acidic solution to planarize the surface of the wafer through a combination of mechanical and chemical action. Generally, a chemical mechanical polishing tool includes a polishing device positioned above a rotatable circular platen or table on which a polishing pad is mounted. The polishing device may include one or more rotating carrier heads to which wafers may be secured, typically through the use of vacuum pressure. In use, the platen may be rotated and an abrasive slurry may be disbursed onto the polishing pad. Once the slurry has been applied to the polishing pad, a downward force may be applied to each rotating carrier head to press the attached wafer against the polishing pad. As the wafer is pressed against the polishing pad, the surface of the wafer is mechanically and chemically polished.

As semiconductor devices are scaled down, the importance of chemical mechanical polishing to the fabrication process increases. In particular, it becomes increasingly important to control and minimize within-wafer topography variations. For example, in one embodiment, to minimize spatial variations in downstream photolithography and etch processes, it is necessary for the oxide thickness of a wafer to be as uniform as possible (i.e., it is desirable for the surface of the wafer to be as planar as possible.)

A variety of factors may contribute to producing variations across the post-polish surface of a wafer. For example, variations in the surface of the wafer may be attributed to drift of the chemical mechanical polishing device. Typically, a chemical mechanical polishing device is optimized for a particular process, but because of chemical and mechanical changes to the polishing pad during polishing, degradation of process consumables, and other processing factors, the chemical mechanical polishing process may drift from its optimized state.

Generally, within-wafer uniformity variations (i e., surface non-uniformity) are produced by slight differences in polish rate at various positions on the wafer. FIG. 1 illustrates two radial profiles of surface non-uniformity typically seen after a process layer (e.g., an oxide layer) is polished. The dished topography 100 is often referred to as a center-fast polishing state because the center of the wafer polishes at a faster rate than the edge of the wafer. The domed topography 110 is designated center-slow because the center of the wafer polishes at a slower rate than the edge of the wafer. For obvious reasons, the dished topography 100 may also be referred to as edge-slow, and the domed topography 110 may also be referred to as edge-fast.

In addition to process drift, pre-polish surface non-uniformity of the process layer may also contribute to producing variations across the post-polish surface of the wafer. For example, prior to being polished, the radial profile of the process layer may be non-uniform (e.g., the surface may exhibit characteristics that are center-fast, center-slow, etc.), and the post-polish surface non-uniformity of the process layer may be exacerbated by the pre-polish condition of the process layer.

Most techniques for controlling surface uniformity affect the mean polishing rate as well as the uniformity of the polishing process. Because of variation in the incoming thickness and profiles of individual process layers, changing the mean polish rate as well as the uniformity makes it difficult to control post-polish thickness of a process layer on a run-to-run basis.

The present invention is directed to overcoming, or at least reducing the effects of, one or more of the problems set forth above.

SUMMARY OF THE INVENTION

One aspect of the present invention is seen in a method for polishing wafers. The method includes providing a wafer having a process layer formed thereon; providing a polishing tool having a plurality of control zones and being adapted to polish the process layer based on an operating recipe, the operating recipe having a control variable corresponding to each of the control zones; measuring a pre-polish thickness profile of the process layer; comparing the pre-polish thickness profile to a target thickness profile to determine a desired removal profile; determining values for the control variables associated with the control zones based on the desired removal profile; and modifying the operating recipe of the polishing tool based on the values determined for the control variables.

Another aspect of the present invention is seen in a processing line including a polishing tool, a metrology tool, and a process controller. The polishing tool is adapted to polish a wafer having a process layer formed thereon based on an operating recipe. The polishing tool includes a plurality of control zones and the operating recipe includes a control variable corresponding to each of the control zones. The metrology tool is adapted to measure a pre-polish thickness profile of the process layer. The process controller is adapted to compare the pre-polish thickness profile to a target thickness profile to determine a desired removal profile, determine values for the control variables associated with the control zones based on the desired removal profile, and modify the operating recipe of the polishing tool based on the values determined for the control variables.

BRIEF DESCRIPTION OF THE DRAWINGS

The invention may be understood by reference to the following description taken in conjunction with the accompanying drawings, in which like reference numerals identify like elements, and in which.

Figure 1:
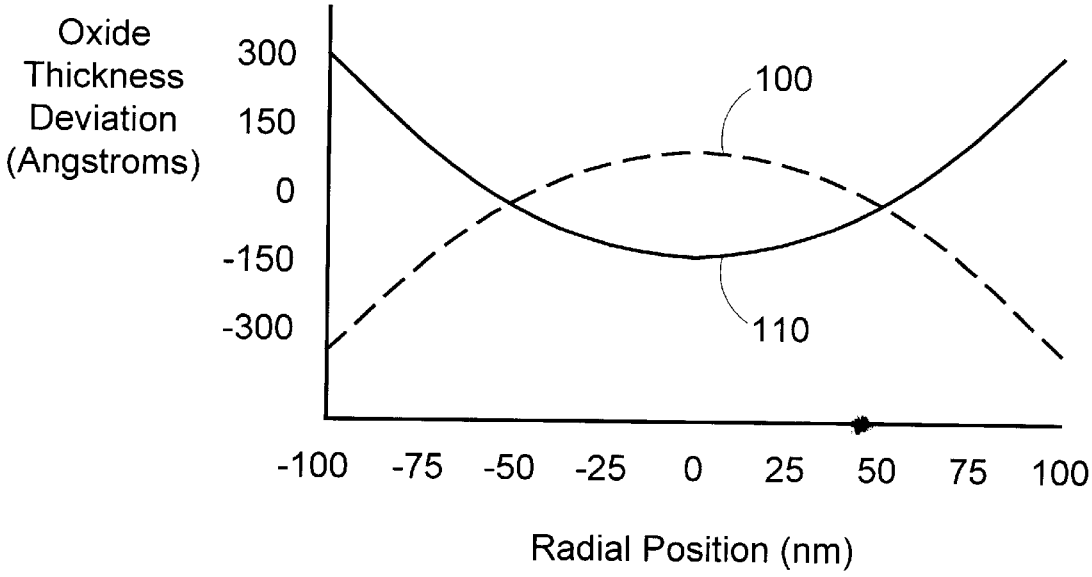
Figure 1 (Prior Art)
FIG. 1 is a graph illustrating surface non-uniformity of a process layer.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 2:
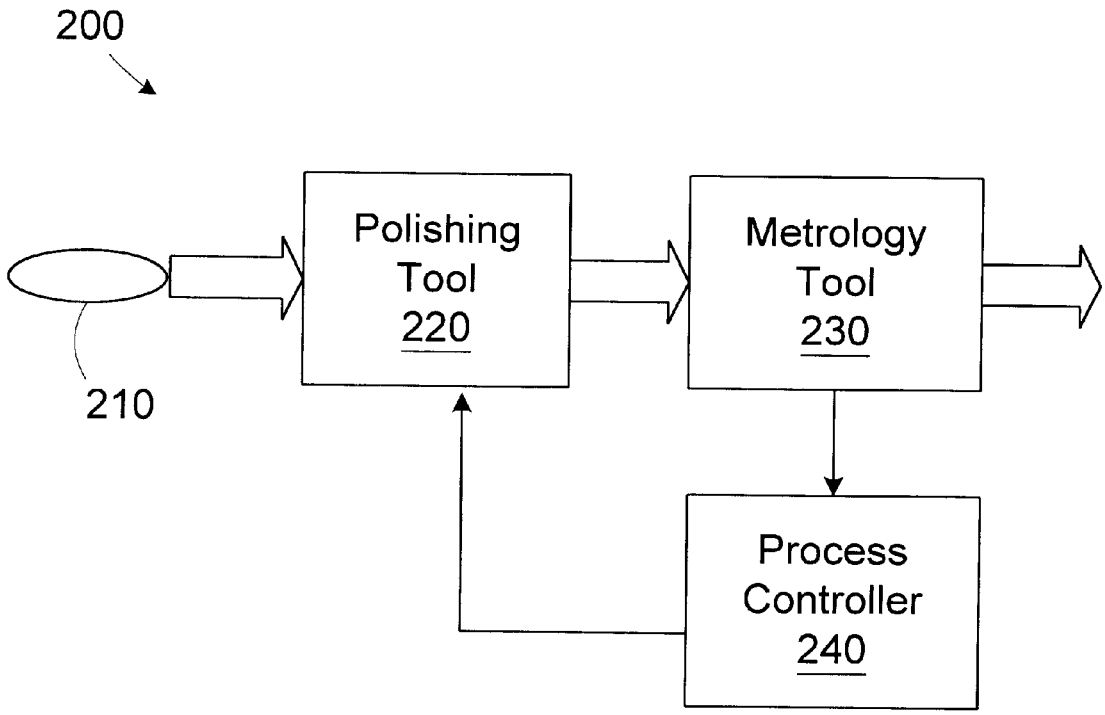
FIG. 2 is a simplified diagram of an illustrative processing line for processing wafers in accordance with one illustrative embodiment of the present invention.

Referring to FIG. 2, a simplified diagram of an illustrative processing line 200 for processing wafers 210 in accordance with one illustrative embodiment of the present invention is provided. The processing line 200 includes a polishing tool 220 for polishing the wafers 210 in accordance with a polishing recipe. The polishing tool 220 may be used to polish process layers formed on the wafer 210, such as silicon dioxide, silicon nitride, metal layers, or other process layers. The processing line 200 includes a metrology tool 230 adapted to measure the thickness profile of the polished wafer as described in greater detail below. The metrology tool 230 may be external to the polishing tool 220 or, alternatively, the metrology tool 230 may be installed in an in-situ arrangement, where surface uniformity measurements may be taken during the polishing process. An exemplary tool suitable for use as the metrology tool 230 is an Optiprobe tool offered by Thermawave, Inc. of Freemont, Calif.

A process controller 240 is provided for modifying the operating recipe of the polishing tool 220 based on information received from the metrology tool 230. The process controller 240 provides feedback to the polishing tool 220 and adjusts its operating recipe to improve the uniformity of the polishing process and reduce polishing variation. In the illustrated embodiment, the process controller 240 is a computer programmed with software to implement the functions described. However, as will be appreciated by those of ordinary skill in the art, a hardware controller designed to implement the particular functions may also be used. Moreover, the functions performed by the process controller 240, as described herein, may be performed by multiple controller devices distributed throughout a system. Additionally, the process controller 240 may be a stand-alone controller, it may be integrated into a tool, such as the polishing tool 220, or it may be part of a system controlling operations in an integrated circuit manufacturing facility.

Portions of the invention and corresponding detailed description are presented in terms of software, or algorithms and symbolic representations of operations on data bits within a computer memory. These descriptions and representations are the ones by which those of ordinary skill in the art effectively convey the substance of their work to others of ordinary skill in the art. An algorithm, as the term is used here, and as it is used generally, is conceived to be a self-consistent sequence of steps leading to a desired result. The steps are those requiring physical manipulations of physical quantities. Usually, though not necessarily, these quantities take the form of optical, electrical, or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise, or as is apparent from the discussion, terms such as "processing" or "computing" or "calculating" or "determining" or "displaying" or the like, refer to the action and processes of a computer system, or similar electronic computing device, that manipulates and transforms data represented as physical, electronic quantities within the computer system's registers and memories into other data similarly represented as physical quantities within the computer system memories or registers or other such information storage, transmission or display devices.

An exemplary software system capable of being adapted to perform the functions of the process controller 240, as described herein, is the Catalyst system offered by KLA-Tencor, Inc. The Catalyst system uses Semiconductor Equipment and Materials International (SEMI) Computer Integrated Manufacturing (CIM) Framework compliant system technologies and is based on the Advanced Process Control (APC) Framework. CIM (SEMI E81-0699- Provisional Specification for CIM Framework Domain Architecture) and APC (SEMI E93-0999- Provisional Specification for CIM Framework Advanced Process Control Component) specifications are publicly available from SEMI.

Figure 3:
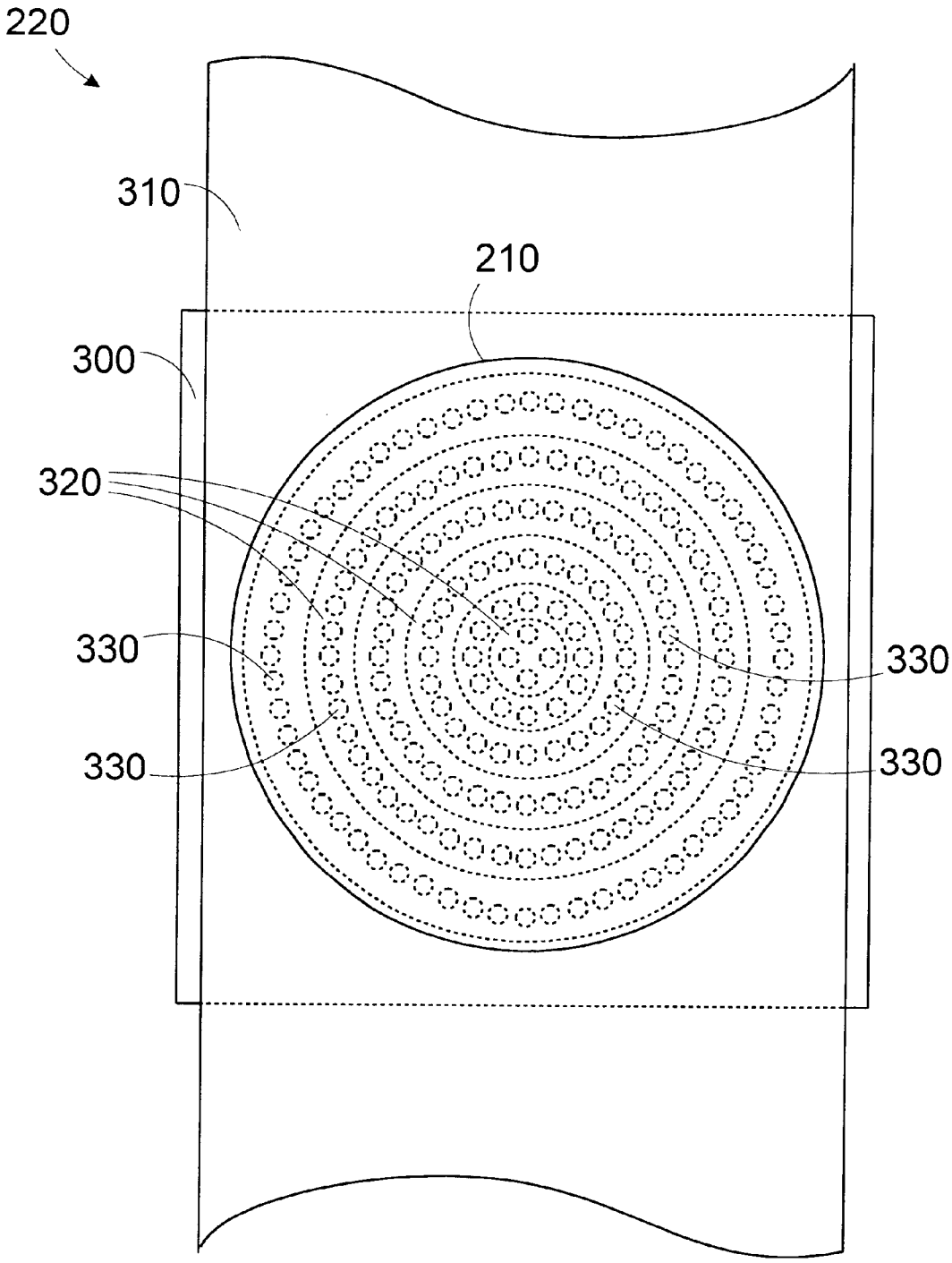
FIG. 3 is a simplified top view of a polishing tool in the processing line of FIG. 2.

Turning now to FIG. 3, a simplified top view of the polishing tool 220 is provided. An exemplary polishing tool 220 that may be controlled as described herein is a Teres CMP system offered by Lam Research Corporation of Fremont, Calif. Of course, the present invention may also be used with other polishing tools. The polishing tool 220 includes a plate 300 over which a rotary belt 310 passes linearly. A wafer 210 including a process layer to be polished is held in position over the rotary belt 310 by a rotatable carrier (not shown) (e.g., by vacuum pressure). The process layer of the wafer 210 is pressed against the moving rotary belt 310 and rotated by the carrier to affect the polishing process. A source of polishing fluid (not shown) may be provided to supply polishing fluid (e.g., slurry) to the rotary belt 310.

The plate 300 includes a plurality of control zones 320 for adjusting the force at which the process layer contacts the rotary belt 310 within the zones 320. Six control zones 320 are depicted in the exemplary embodiment of FIG. 3, however, a different number may be employed in other embodiments. In the illustrated embodiment, the plate 320 includes a plurality of concentric gas headers 330 with individually controllable gas pressures. In the illustrated embodiment, air is used as the gas medium. The pressure of the gas provided to each of the concentric gas headers 330 may be varied to affect the local polishing rate of the polishing tool 220 within each of the control zones 320.

Returning to FIG. 2, the process controller 240 may use information collected by the metrology tool 230 to characterize the performance of the polishing tool 220 and determine its polishing profile. In the illustrated embodiment, the process controller 240 uses a combination of feed-forward and feedback information collected by the metrology tool 230 to predict operating recipe parameters (i.e., feed-forward) for incoming wafers to be polished and to adjust the predictive model for subsequent polishing operations (i.e., feedback). The local polish rate profile for each control zone 320 may be determined and used by the process controller 240 to control the gas pressure provided at each of the concentric gas headers 330, as described in greater detail below.

The process controller 240 models the removal rate (rr) of the polishing tool 220 as a function of radius (r) per the following equation:

$$rr(r) = k_0(r) + \sum_i (k_{1,i}(r) \cdot P_i + k_{2,i}(r) \cdot P_i^2), \quad (1)$$

where $k_{1,i}$ and $k_{2,i}$ are fixed, model-state parameters, $P_i$ is the pressure in the control zone 320 corresponding to i, and $k_0$ is an intercept parameter. The tool states are the set of $k_0$ values at the measured radii. The process controller 240 determines the $k_0$ values using pre-polishing and post-polishing data collected by the metrology tool 230 to calculate the removal rate at each radius and solving Equation 1 for $k_0$. The values for $k_{1,i}$ and $k_{2,i}$ are determined by experiment. An exemplary technique for determining the model-state parameters includes calculating a "master set" of parameters using blanket wafers and determining scaling factors for each different product (e.g., a particular product may have parameters that are twice those of a blanket wafer). Because scaling factors are used, the experimentation does not need to be repeated for each product.

For incoming wafers, the metrology tool 230 measures the thickness of the process layer to be polished at various points on the wafer. If the wafer is not measured in the same radial positions that correspond to the control zones 320, the process controller 240 may use a polynomial fit to determine the approximate thickness at those positions. The process controller 240 subtracts the pre-polish thickness profile from a desired post-polish target thickness profile to generate a desired removal profile (i.e., as a function of the radius). The process controller 240 determines a predicted removal profile (prp) for the polishing tool 220 for a given polishing time and set of pressures, $P_i$, using the following equation:

$$prp(r) = \left(k_0(r) + \sum_i (k_{1,i}(r) \cdot P_i + k_{2,i}(r) \cdot P_i^2)\right) \cdot t \quad (2)$$

The process controller 250 uses a nonlinear technique to simultaneously solve Equation 2 to determine the values for time, t, and the pressures, $P_i$. The values may be determined by minimizing the sum of the squared differences between the desired removal profile and the predicted removal profile, prp, over all radii. For example, the MATLAB software application offered by MathWorks, Inc. of Natick, MA or the Excel equation solver offered by Microsoft Corporation of Redmond, Wash. may be used.

After the polishing tool 220 completes the polishing process, the metrology tool 230 measures the post-polish thickness profile in the radial positions corresponding to the control zones 320. Again, the process controller 240 may use a polynomial fit to determine the approximate thickness at those positions if the measurement positions do not match the control positions. An actual removal profile is determined by subtracting the pre-polish thickness profile from the post-polish thickness profile. The process controller 240 uses the actual removal profile to solve Equation 1 for the initial state values, $k_0$. The process controller 240 thus updates the control states after each iteration to improve the accuracy and repeatability of the control model.

Figure 4:
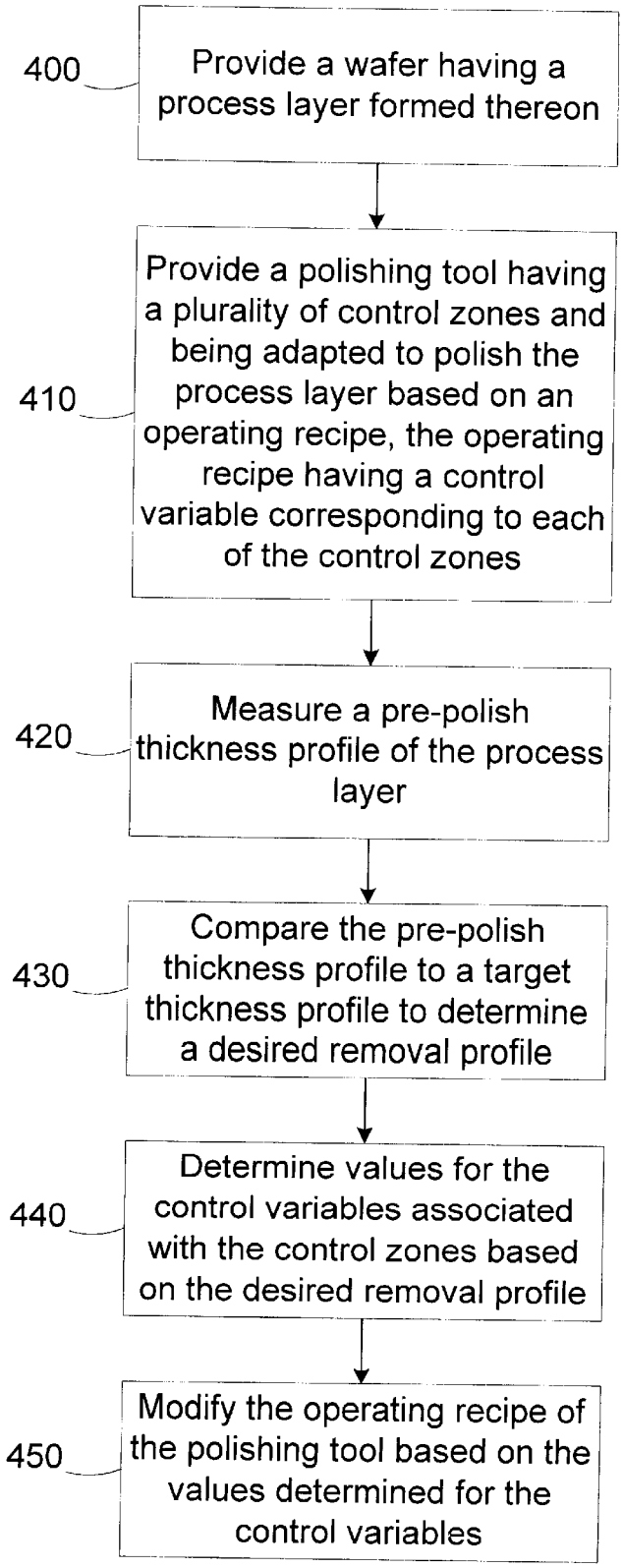
FIG. 4 is a simplified flow diagram of a method for polishing wafers in accordance with another illustrative embodiment of the present invention.

Turning now to FIG. 4, a simplified flow diagram of a method for polishing process layers in accordance with another illustrative embodiment of the present invention is provided. In block 400, a wafer having a process layer formed thereon is provided. In block 410, a polishing tool having a plurality of control zones and being adapted to polish the process layer based on an operating recipe is provided. The operating recipe has a control variable corresponding to each of the control zones. In block 420, a pre-polish thickness profile of the process layer is measured. In block 430, the pre-polish thickness profile is compared to a target thickness profile to determine a desired removal profile. In block 440, values for the control variables associated with the control zones are determined based on the desired removal profile. In block 450, the operating recipe of the polishing tool is modified based on the values determined for the control variables.

Controlling the operating recipe of the polishing tool 220, as described above allows run-to-run control of the polishing process. Variation present in the surface uniformity of the incoming wafers can be taken into account and the polish process can be correspondingly adjusted to reduce post-polish variation in the processed wafers. Using run-to-run control with separate control zones 320, the thickness profiles of the polished wafers are closer to the target thickness profile, as compared to other methods of uniformity control. This increased consistency results in a corresponding increase in consistency for other process steps performed after the polishing, thus improving the efficiency of the processing line 100 and the quality of the completed semiconductor devices.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A method for polishing wafers, comprising:

providing a wafer having a process layer formed thereon;

providing a polishing tool having a plurality of control zones and being adapted to polish the process layer based on an operating recipe, the operating recipe having a control variable corresponding to each of the control zones;

measuring a pre-polish thickness profile of the process layer;

comparing the pre-polish thickness profile to a target thickness profile to determine a desired removal profile;

determining values for the control variables associated with the control zones based on the desired removal profile; and modifying the operating recipe of the polishing tool based on the values determined for the control variables.

2. The method of claim 1, further comprising polishing the process layer based on the modified operating recipe.

3. The method of claim 2, further comprising measuring a post-polish thickness profile of the process layer.

4. The method of claim 3, wherein determining values for the control variables further comprises determining the values using a control model having a control state variable associated with each of the control zones, and the method further comprises updating the control state variables based on the pre-polish thickness profile and the post-polish thickness profile.

5. The method of claim 1, wherein determining values for the control variables associated with the control zones based on the desired removal profile further comprises:

determining a plurality of predicted removal profiles for a plurality of combinations of the control variable values; and selecting a particular combination of control variable values associated with the predicted removal profile closest to the desired removal profile.

6. The method of claim 5, wherein selecting the particular combination of control variable values comprises selecting the particular combination of control variable values associated with the predicted removal profile having a minimum least squared difference between the predicted removal profile and the desired removal profile.

7. The method of claim 1, wherein providing the polishing tool comprises providing the polishing tool having a plurality of concentric control zones.

8. The method of claim 7, wherein the polishing tool comprises a plate and a polishing surface adapted to move over the plate, each concentric control zone comprises a gas header defined in the plate for exerting a force on the polishing surface, and determining values for the control variables further comprises determining a gas pressure value for each of the gas headers.

9. The method of claim 8, wherein determining values for the control variables associated with the control zones based on the desired removal profile further comprises:

determining a plurality of predicted removal profiles for a plurality of combinations of gas pressure values; and selecting a particular combination of gas pressure values associated with the predicted removal profile closest to the desired removal profile.

10. The method of claim 9, wherein selecting the particular combination of gas pressure values comprises selecting the particular combination of gas pressure values associated with the predicted removal profile having a minimum least squared difference between the predicted removal profile and the desired removal profile.

11. A method for polishing wafers, comprising:

providing a wafer having a process layer formed thereon;

providing a polishing tool comprising a plate, a polishing surface adapted to move over the plate, and a plurality of gas headers defined in the plate for exerting a force on the polishing surface, each gas header having an associated control zone and an associated gas pressure control variable;

measuring a pre-polish thickness profile of the process layer;

comparing the pre-polish thickness profile to a target thickness profile to determine a desired removal profile;

determining values for the gas pressure control variables associated with the control zones based on the desired removal profile; and modifying an operating recipe of the polishing tool based on the gas pressure control variables.

12. The method of claim 11, further comprising polishing the process layer based on the modified operating recipe.

13. The method of claim 12, further comprising measuring a post-polish thickness profile of the process layer.

14. The method of claim 13, wherein determining values for the gas pressure control variables further comprises determining the values using a control model having a control state variable associated with each of the control zones, and the method further comprises updating the control state variables based on the pre-polish thickness profile and the post-polish thickness profile.

15. The method of claim 11, wherein determining values for the gas pressure control variables associated with the control zones based on the desired removal profile further comprises:

determining a plurality of predicted removal profiles for a plurality of combinations of gas pressure control variable values; and selecting a particular combination of gas pressure control variables values associated with the predicted removal profile closest to the desired removal profile.

16. The method of claim 15, wherein selecting the particular combination of gas pressure control variable values comprises selecting the particular combination of gas pressure control variable values associated with the predicted removal profile having a minimum least squared difference between the predicted removal profile and the desired removal profile.

17. A processing line, comprising:

a polishing tool adapted to polish a wafer having a process layer formed thereon based on an operating recipe, the polishing tool having a plurality of control zones and the operating recipe having a control variable corresponding to each of the control zones;

a metrology tool adapted to measure a pre-polish thickness profile of the process layer; and a process controller adapted to compare the pre-polish thickness profile to a target thickness profile to determine a desired removal profile, determine values for the control variables associated with the control zones based on the desired removal profile, and modify the operating recipe of the polishing tool based on the values determined for the control variables.

18. The processing line of claim 17, wherein the metrology tool is further adapted to measure a post-polish thickness profile of the process layer.

19. The processing line of claim 18, wherein the process controller is further adapted to determine values for the control variables using a control model having a control state variable associated with each of the control zones, and update the control state variables based on the pre-polish thickness profile and the post-polish thickness profile.

20. The processing line of claim 17, wherein the process controller is further adapted to determine a plurality of predicted removal profiles for a plurality of combinations of the control variable values, and select a particular combination of control variable values associated with the predicted removal profile closest to the desired removal profile.

21. The processing line of claim 20, wherein the process controller is further adapted to select the particular combination of control variable values associated with the predicted removal profile having a minimum least squared difference between the predicted removal profile and the desired removal profile.

22. The processing line of claim 17, wherein control zones comprise concentric control zones.

23. The processing line of claim 22, wherein the polishing tool further comprises a plate and a polishing surface adapted to move over the plate, each concentric control zone comprises a gas header defined in the plate for exerting a force on the polishing surface, and the process controller is further adapted to determine a gas pressure value for each of the gas headers.

24. The processing line of claim 23, wherein the process controller is further adapted to determine a plurality of predicted removal profiles for a plurality of combinations of gas pressure values and select a particular combination of gas pressure values associated with the predicted removal profile closest to the desired removal profile.

25. The processing line of claim 24, wherein the process controller is further adapted to select the particular combination of gas pressure values associated with the predicted removal profile having a minimum least squared difference between the predicted removal profile and the desired removal profile.

26. A processing line, comprising:

a polishing tool adapted to polish a wafer having a process layer formed thereon based on an operating recipe, the polishing tool polishing tool comprising a plate, a polishing surface adapted to move over the plate, and a plurality of gas headers defined in the plate for exerting a force on the polishing surface, each gas header having an associated control zone and an associated gas pressure control variable;

a metrology tool adapted to measure a pre-polish thickness profile of the process layer; and a process controller adapted to compare the pre-polish thickness profile to a target thickness profile to determine a desired removal profile, determine values for the gas pressure control variables associated with the control zones based on the desired removal profile, and modify an operating recipe of the polishing tool based on the gas pressure control variables.

27. The processing line of claim 26, wherein the metrology tool is further adapted to measure a post-polish thickness profile of the process layer.

28. The processing line of claim 27, wherein the process controller is further adapted to determine values for the gas pressure control variables using a control model having a control state variable associated with each of the control zones and update the control state variables based on the pre-polish thickness profile and the post-polish thickness profile.

29. The processing line of claim 26, wherein the process controller is further adapted to determine a plurality of predicted removal profiles for a plurality of combinations of gas pressure control variable values and select a particular combination of gas pressure control variables values associated with the predicted removal profile closest to the desired removal profile.

30. The processing line of claim 29, wherein the process controller is further adapted to select the particular combination of gas pressure control variable values associated with the predicted removal profile having a minimum least squared difference between the predicted removal profile and the desired removal profile.

31. A processing line, comprising:

means for polishing a wafer having a process layer formed thereon using a plurality of control zones, each control zone having an associated control variable;

means for measuring a pre-polish thickness profile of the process layer;

means for comparing the pre-polish thickness profile to a target thickness profile to determine a desired removal profile; and means for determining values for the control variables associated with the control zones based on the desired removal profile.

32. A method for polishing wafers, comprising:

providing a wafer having a process layer formed thereon;

providing a polishing tool having a plurality of control zones and being adapted to polish the process layer based on an operating recipe, the operating recipe having at lest one control variable corresponding to at least one of the control zones;

measuring a pre-polish thickness profile of the process layer;

comparing the pre-polish thickness profile to a target thickness profile to determine a desired removal profile;

determining a value for the control variable based on the desired removal provile; and modifying the operating recipe of the polishing tool based on the value determined for the control variable.

33. The method of claim 32, further comprising polishing the process layer based on the modified operationg recipe.

34. The method of claim 33, further comprising measuring a post-polish thickness profile of the process layer.

35. The method of claim 32, wherein determining the value for the control variable further comprises determining the value using a control model having a control state variable associated with the control variable, and the method further comprises updating the control state variable based on the pre-polish thickness profile and the post-polish thickness profile.

36. A processing line, comprising:

a polishing tool adapted to polish a wafer having a process layer formed thereon based on and operating recipe, the polishing tool having a plurality of control zones and the operating recipe having at least one control variable associated with at least one of the control zones;

a metrology tool adapted to measure a pre-polish thickness profile of the process layer; and a process controller adapted to compare the pre-polish thickness profile to a target thickness profile to determine a desired removal profile, determine a value for the control variable based on the desired removal profile, and modify the operating recipe of the polishing tool based on the value determined for the control variable.

37. The processing line of claim 36, wherein the metrology tool is further adapted to measure a post-polish thickness profile of the process layer.

38. The processing line of claim 37, wherein the process controller is further adapted to detrmine the value for the control variable using a control model having a control state variable associated with the control variable, and update the control state variable based on the pre-polish thickness profile and the post-polish thickness profile.

39. The processing line of claim 36, wherein the process controller is further adapted to determine a plurality of predicted removal profiles for a plurality of combinations of the control variable values, and select a particular combination of control variable values associated with the predicted removal profile closest to the desired removal profile.

40. A processing line, comprising:

means for providing a wafer having a process layer formed theron;

means for polishing a wafer having a process layer formed thereon using a plurality of control zones based on an operating recipe, the operating recipe having as least one control variable corresponding to at least one of the control zones;

means for measuring a pre-polish thickness profile of the process layer;

means for comparing the pre-polish thickness profile to a target thickness profile to determine a desired removal profile;

means for determining a value for the cotrol variable based on the desired removal profile; and means for modifing the operating recipe of posishing tool based on the value determined for the control variable.

* * * * *

UNITED STATES PATENT AND TRADEMARK OFFICE

CERTIFICATE OF CORRECTION

PATENT NO. : 6,540,591 B1
DATED : April 1, 2003
INVENTOR(S) : Pasadyn et al.

It is certified that error appears in the above-identified patent and that said Letters Patent is hereby corrected as shown below:

Title page,
Delete "[*] Notice: Subject to any disclaimer, the term of this patent is extended or adjusted under 35 U.S.C. 154(b) by 0 days." and insert -- [*] Notice: Subject to any discalimer, the term of this patent is extended or adjusted under 35 U.S.C. 154(b) by 43 days. --

Signed and Sealed this

Twenty-sixth Day of August, 2003

JAMES E. ROGAN
*Director of the United States Patent and Trademark Office*